US009242140B1

(12) United States Patent
Yang

(10) Patent No.: US 9,242,140 B1
(45) Date of Patent: Jan. 26, 2016

(54) STEPPING EXERCISER HAVING CONNECTING DEVICE

(71) Applicant: Chung-Chin Yang, Taoyuan County (TW)

(72) Inventor: Chung-Chin Yang, Taoyuan County (TW)

( * ) Notice: Subject to any disclaimer, the term of this patent is extended or adjusted under 35 U.S.C. 154(b) by 0 days.

(21) Appl. No.: 14/514,357

(22) Filed: Oct. 14, 2014

(51) Int. Cl.

| | |
|---|---|
| ***A63B 22/04*** | (2006.01) |
| ***A63B 23/04*** | (2006.01) |
| ***A63B 26/00*** | (2006.01) |
| ***A63B 22/00*** | (2006.01) |
| ***A63B 21/02*** | (2006.01) |

(52) U.S. Cl.
CPC ..... *A63B 23/04* (2013.01); *A63B 21/02* (2013.01); *A63B 22/0056* (2013.01); *A63B 22/04* (2013.01); *A63B 26/003* (2013.01)

(58) Field of Classification Search
CPC .... A63B 21/02; A63B 21/026; A63B 21/028; A63B 21/04; A63B 21/0414; A63B 21/0421; A63B 21/05; A63B 22/0048; A63B 22/0056; A63B 22/0061; A63B 22/0064; A63B 22/0069; A63B 22/04; A63B 23/04; A63B 23/0417; A63B 23/0429; A63B 23/0458; A63B 23/08; A63B 23/085; A63B 23/10; A63B 25/10; A63B 26/003; A63B 2023/0441; A63B 2023/0447; A63B 2023/0452; A63B 2026/006; A63B 2225/09; A43B 13/182–13/185; A61H 1/0266; A61H 2205/12
USPC ..... 482/52, 77, 79, 80, 146, 147; 601/27–32
See application file for complete search history.

(56) References Cited

U.S. PATENT DOCUMENTS

| | | | | | |
|---|---|---|---|---|---|
| 4,886,050 | A * | 12/1989 | Iams | A63B 23/0355 | 434/255 |
| 5,205,798 | A * | 4/1993 | Lekhtman | A43B 13/18 | 482/121 |
| 5,304,106 | A * | 4/1994 | Gresko | A63B 22/0056 | 482/53 |
| 5,480,368 | A * | 1/1996 | Huang | A63B 21/157 | 482/123 |
| 5,954,621 | A * | 9/1999 | Joutras | A43B 1/00054 | 482/114 |
| 6,318,001 | B1 * | 11/2001 | Lee | A43B 13/184 | 36/27 |
| 6,436,012 | B1 * | 8/2002 | Naville | A43B 5/00 | 36/114 |
| 6,935,992 | B2 * | 8/2005 | Gehrke | A47C 20/021 | 482/100 |
| 8,944,970 | B2 * | 2/2015 | Raumann | A61H 1/0259 | 482/51 |
| 2005/0233869 | A1 * | 10/2005 | Lee | A63B 25/08 | 482/77 |
| 2011/0111927 | A1 * | 5/2011 | Kim | A63B 21/00192 | 482/52 |
| 2014/0349817 | A1 * | 11/2014 | Yang | A63B 5/11 | 482/52 |
| 2014/0349818 | A1 * | 11/2014 | Green | A63B 21/1426 | 482/77 |

FOREIGN PATENT DOCUMENTS

| | | | | |
|---|---|---|---|---|
| DE | 4032283 A1 * | 4/1992 | ..... | B60N 2/2218 |

* cited by examiner

*Primary Examiner* — Loan H Thanh
*Assistant Examiner* — Gregory Winter
(74) *Attorney, Agent, or Firm* — Chun-Ming Shih

(57) ABSTRACT

A stepping exerciser having a connecting device for training balance includes two stepping units and a connecting unit disposed between the two stepping units. Through the connecting unit, the two stepping units can be used in a stable state to enhance safety of use. Furthermore, because the connecting unit provides an angle adjustment function, the relative position of the two stepping units can be changed. The use of the stepping exerciser can be adjusted according to the user's own physical status and age. The present invention provides a variety of changes for use so as to train balance and muscles throughout the body. The exercise effect and amusement of use can be enhanced.

5 Claims, 9 Drawing Sheets

STEPPING EXERCISER HAVING CONNECTING DEVICE

BACKGROUND OF THE INVENTION

1. Field of the Invention

The present invention relates to a stepping exerciser, and more particularly to a stepping exerciser having a connecting device to enhance safety and variation of use.

2. Description of the Prior Art

There are many sports apparatuses on the market, such as treadmills, rowing machines, stationary bikes, and the like. These products are large in size and expensive, and provide a single function. It is difficult to attract consumers to purchase the sports apparatuses.

Although a conventional stepping exerciser is small in size, it only provides up and down motions. It is boring to do such a monotonous exercise after a period of time.

Therefore, the inventor of the present invention deems it is necessary to develop a compact and changeable sports apparatus. A conventional stepping exerciser invented by the inventor comprises two boards and two corresponding elastic plates disposed between the two boards. The user can tread on the exerciser to do up and down exercise. As shown in FIG. 1, the stepping exerciser 8 is composed of two units. Although it is fun to use the stepping exercise, the user who has less sense of balance may fall from the stepping exerciser.

Accordingly, the inventor of the present invention has devoted himself based on his many years of practical experiences to solve these problems.

SUMMARY OF THE INVENTION

The primary objective of the present invention is to provide a stepping exerciser having a connecting device to improve the shortcomings of the conventional stepping exerciser. The stepping exerciser of the present invention comprises two stepping units and a connecting unit disposed between the two stepping units. The stepping exerciser can be used in a stable state to enhance safety of use, in particularly, to train balance.

A further objective of the present invention is to provide a stepping exerciser having a connecting device. The stepping exerciser of the present invention comprises two stepping units and a connecting unit disposed between the two stepping units. Because the connecting unit provides an angle adjustment function, the relative position of the two stepping units can be changed so that the use of the stepping exerciser can be in various states to train muscles throughout the body and to enhance amusement of exercise.

In order to achieve the aforesaid objective, the stepping exerciser of the present invention comprises two stepping units and a connecting unit.

Each stepping unit comprises an upper board and a lower board. The upper board is connected with an upper elastic plate extending downward from the upper board. The lower board is connected with a lower elastic plate extending upward from the lower board. The upper elastic plate and the lower elastic plate each have an arc-like shape. Two ends of the upper elastic plate and the lower elastic plate are connected.

In an embodiment of the present invention, the two ends of the upper elastic plate and the lower elastic plate are pivotally connected with shaft members, respectively.

In an embodiment of the present invention, the connecting unit is connected between the lower boards of the two stepping units. The connecting unit comprises a first connecting member, a second connecting member, an axle member, an elastic member, and a turning member. One end of the first connecting member is formed with a first opening. The first opening is connected with the lower board of one of the stepping units through a screw unit. The first connecting member comprises a first circular plate. The first circular plate is formed with a first through hole at a central portion thereof and a plurality of first ratchets disposed radially around the first through hole. One end of the second connecting member is formed with a second opening. The second opening is connected with the lower board of the other of the stepping units through another screw unit. The second connecting member comprises a second circular plate. The second circular plate is formed with a second through hole at a central portion thereof and a plurality of second ratchets disposed radially around the second through hole. The axle member is inserted through the second through hole, the first through hole, and the elastic member in sequence, and then threadedly connected with the turning member.

In an embodiment of the present invention, the first through hole has a circular shape, the second through hole has a rectangular shape, the inner bottom of the axle member is provided with a block member, and the block member is able to engage with the second through hole.

In an embodiment of the present invention, the axle member is first inserted through a cylinder member and then locked to the second connecting member.

In an embodiment of the present invention, the top and the bottom of the elastic member each provided with a spacer, respectively.

When in use, the stepping exerciser of the present invention is more stable and safe for training balance.

DETAILED DESCRIPTION OF THE PREFERRED EMBODIMENTS

Embodiments of the present invention will now be described, by way of example only, with reference to the accompanying drawings.

Figure 1:
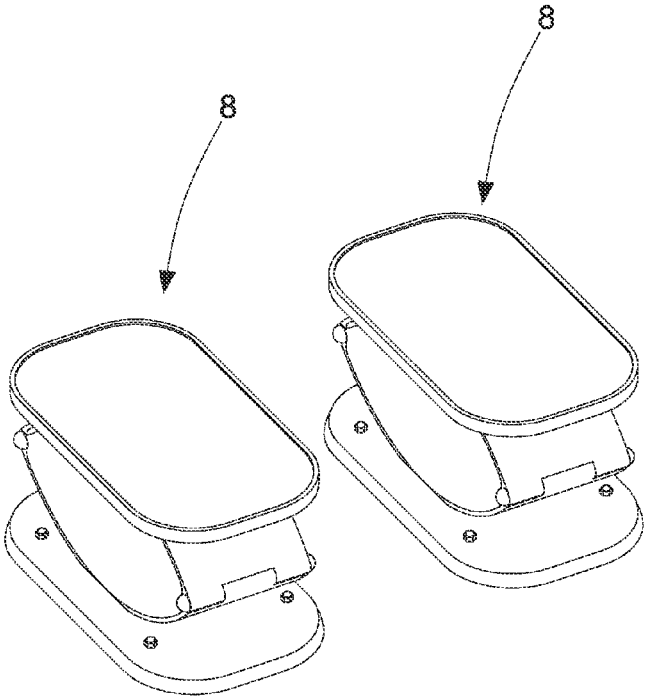
Prior Art Fig.1
FIG. 1 is a perspective view of a conventional stepping exerciser.
Figure 2:
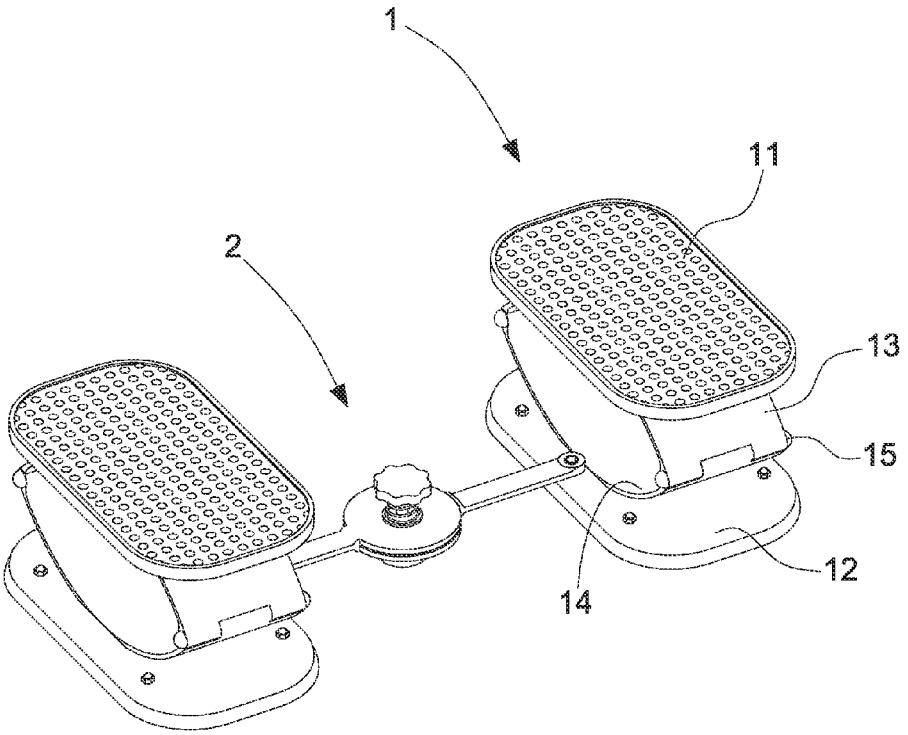
FIG. 2 is a perspective view of the present invention.
Figure 3:
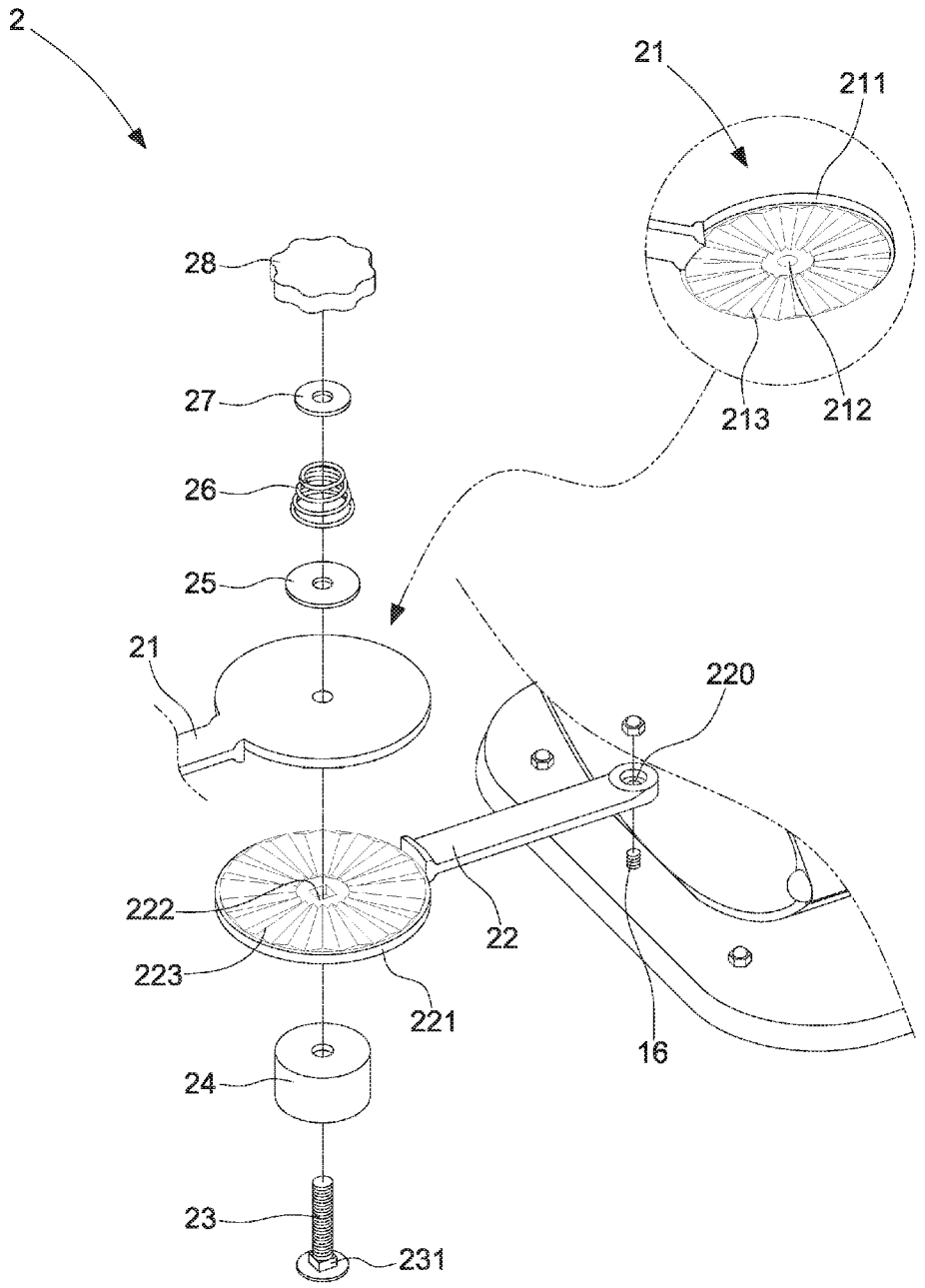
FIG. 3 is a partial exploded view of the present invention.
Figure 4:
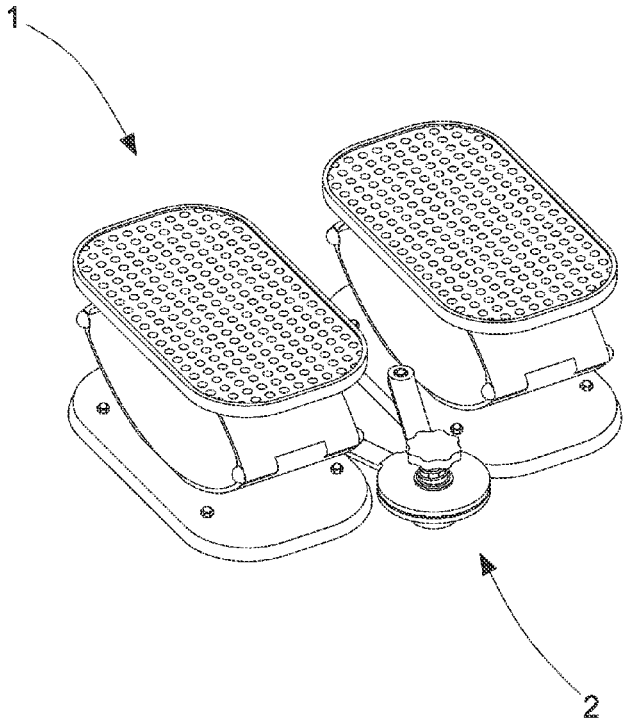
FIG. 4 is a perspective view of the present invention in a use state.
Figure 5:
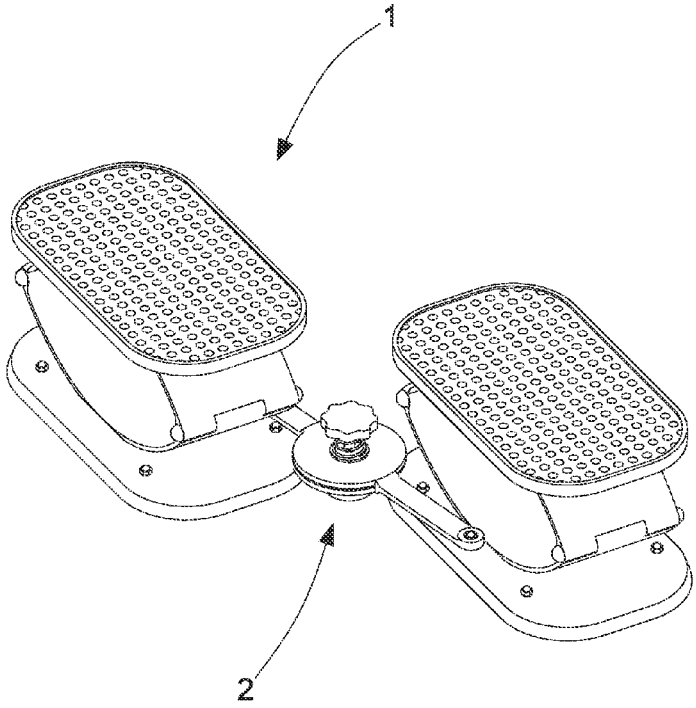
FIG. 5 is a perspective view of the present invention in another use state.

As shown in FIG. 2 and FIG. 3, the present invention discloses a stepping exerciser having a connecting device for training balance. The stepping exerciser comprises two stepping units 1 and a connecting unit 2 connected between the two stepping units 1.

Each stepping unit 1 comprises an upper board 11 and a lower board 12. The upper board 11 is connected with an upper elastic plate 13 extending downward from the upper board 11. The lower board 12 is connected with a lower elastic plate 14 extending upward from the lower board 12. The upper elastic plate 13 and the lower elastic plate 14 each have an arc-like shape. Two ends of the upper elastic plate 13 and the lower elastic plate 14 are pivotally connected with shaft members 5, respectively. When the upper board 11 is applied with a force, the upper elastic plate 13 and the lower elastic plate 14 will provide an elastic function.

Figure 6:
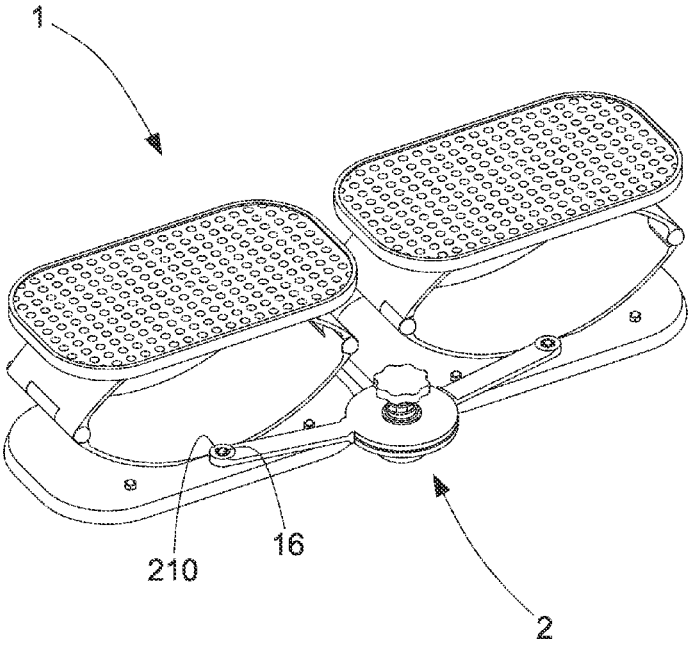
FIG. 6 is a perspective view of the present invention in another use state.
Figure 7:
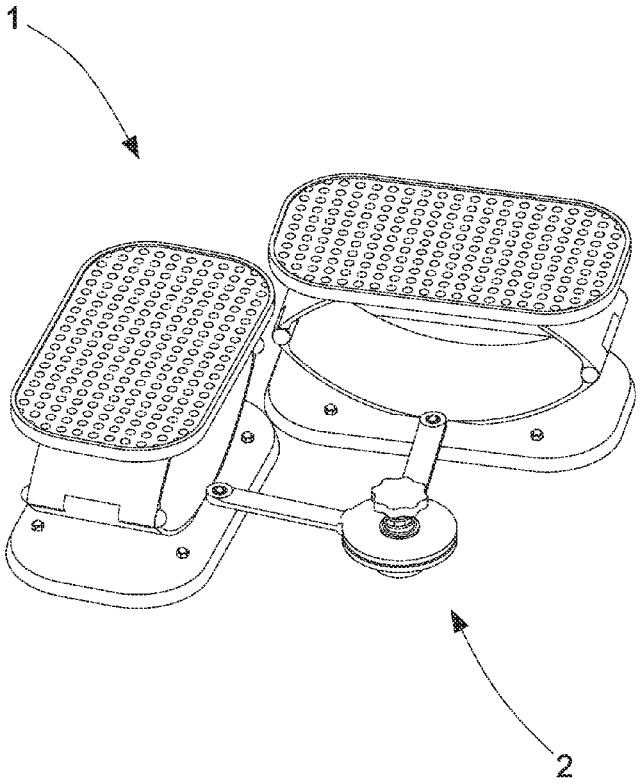
FIG. 7 is a perspective view of the present invention in another use state.
Figure 8:
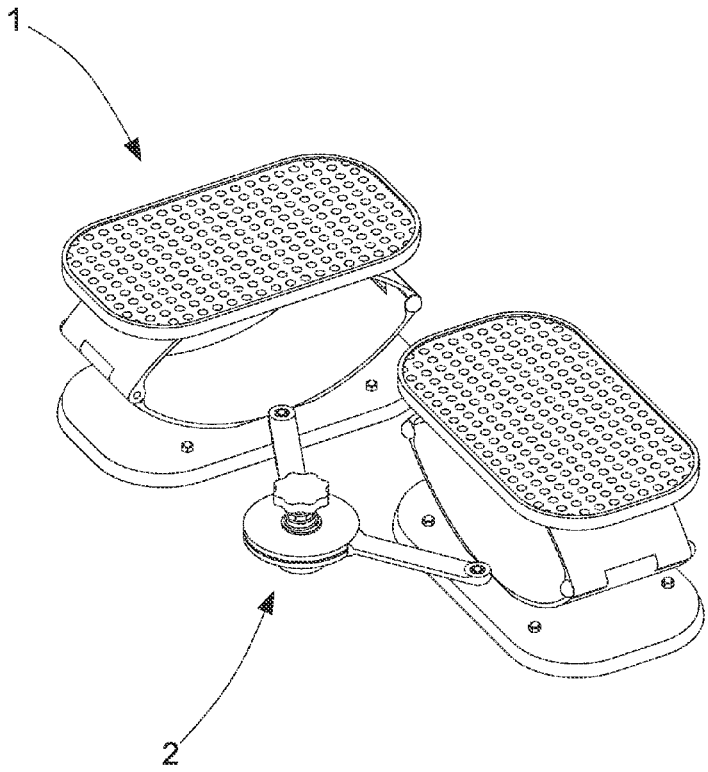
FIG. 8 is a perspective view of the present invention in another use state.

The connecting unit 2 comprises a first connecting member 21, a second connecting member 22, an axle member 23, a cylinder member 24, an elastic member 26, and a turning member 28. One end of the first connecting member 21 is formed with a first opening 210, as shown in FIG. 6. The first opening 210 is connected with the lower board 12 of one of the stepping units 1 through a screw unit 16. The first connecting member 21 comprises a first circular plate 211. The first circular plate 211 is formed with a first through hole 212 at a central portion thereof and a plurality of first ratchets 213 disposed radially around the first through hole 212. One end of the second connecting member 22 is formed with a second opening 220. The second opening 220 is connected with the lower board 12 of the other of the stepping units 1 through another screw unit 16. The second connecting member 22 comprises a second circular plate 221. The second circular plate 221 is formed with a second through hole 222 at a central portion thereof and a plurality of second ratchets 223 disposed radially around the second through hole 222. The axle member 23 is inserted through the second through hole 222, the first through hole 212, and the elastic member 26 in sequence, and then threadedly connected with the turning member 28.

The first through hole 212 has a circular shape. The second through hole 222 has a rectangular shape. The inner bottom of the axle member 23 is provided with a block member 231. The block member 231 is able to engage with the second through hole 222, so that the axle member 23 is adapted to fix the angle of the second connecting member 22.

The axle member 23 is first inserted through the cylinder member 24, and then locked to the second connecting member 23. The cylinder member 24 is able to support the height of the connecting unit 2, preventing the connecting unit 2 from sagging.

When the elastic member 26 is fitted on the axle member 23, the top and the bottom of the elastic member 26 are provided with a spacer 25, 27, respectively.

As shown in FIG. 4 to FIG. 8, the two stepping units 1 of the present invention can be adjusted through the connecting unit 2 to change the stepping angle. The turning member 28 is used to position and provide an engaging force. As shown in the drawings, when in use, the present invention can provide multiple use states. When the user treads on the present invention, the user's feet can change various postures through the prevent invention to train muscles throughout the body and to enhance variation and amusement of use, in particular, to train balance.

Figure 9:
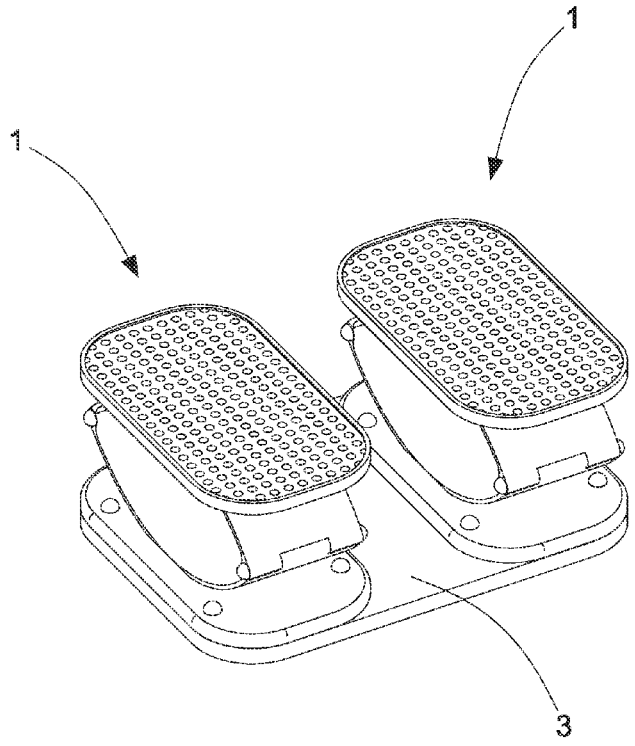
FIG. 9 is a perspective view of another embodiment of the present invention.

As shown in FIG. 9, the present invention further comprises a flat board 3 disposed at the bottom of the two stepping units 1 to provide a stable function.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A stepping exerciser having a connecting device, comprising:

two stepping units, each stepping unit comprising an upper board and a lower board, the upper board being connected with an upper elastic plate extending downward from the upper board, the lower board being connected with a lower elastic plate extending upward from the lower board, the upper elastic plate and the lower elastic plate each having an arc-like shape, two ends of the upper elastic plate and the lower elastic plate being connected;

a connecting unit connected between the lower boards of the two stepping units, the connecting unit comprising a first connecting member, a second connecting member, an axle member, an elastic member, and a turning member, one end of the first connecting member being formed with a first opening, the first opening being connected with the lower board of one of the stepping units through a screw unit, the first connecting member comprising a first circular plate, the first circular plate being formed with a first through hole at a central portion thereof and a plurality of first ratchets disposed radially around the first through hole, one end of the second connecting member being formed with a second opening, the second opening being connected with the lower board of the other of the stepping units through another screw unit, the second connecting member comprising a second circular plate, the second circular plate being formed with a second through hole at a central portion thereof and a plurality of second ratchets disposed radially around the second through hole, the axle member being inserted through the second through hole, the first through hole, and the elastic member in sequence and threadedly connected with the turning member.

2. The stepping exerciser as claimed in claim 1, wherein the two ends of the upper elastic plate and the lower elastic plate are pivotally connected with shaft members, respectively.

3. The stepping exerciser as claimed in claim 1, wherein the first through hole has a circular shape, the second through hole has a rectangular shape, an inner bottom of the axle member is provided with a block member, and the block member is able to engage with the second through hole.

4. The stepping exerciser as claimed in claim 1, wherein the axle member is first inserted through a cylinder member and then locked to the second connecting member.

5. The stepping exerciser as claimed in claim 1, wherein a top and a bottom of the elastic member are provided with a spacer, respectively.

* * * * *